US006698509B2

(12) United States Patent
Rong

(10) Patent No.: US 6,698,509 B2
(45) Date of Patent: Mar. 2, 2004

(54) HEAT EXCHANGERS WITH FLOW DISTRIBUTING ORIFICE PARTITIONS

(75) Inventor: Xiaoyang Rong, Toronto (CA)

(73) Assignee: Dana Canada Corporation, Oakville (CA)

( * ) Notice: Subject to any disclaimer, the term of this patent is extended or adjusted under 35 U.S.C. 154(b) by 0 days.

(21) Appl. No.: 09/974,611

(22) Filed: Oct. 9, 2001

(65) Prior Publication Data

US 2002/0079093 A1 Jun. 27, 2002

(30) Foreign Application Priority Data

Oct. 10, 2000 (CA) ..... 2323026

(51) Int. Cl.[7] ..... F28D 1/02; F28D 7/06; F28F 9/02

(52) U.S. Cl. ..... 165/153; 165/174; 165/176

(58) Field of Search ..... 165/153, 176, 165/164, 109.1, 174

(56) References Cited

U.S. PATENT DOCUMENTS

| | | | | |
|---|---|---|---|---|
| 3,976,128 A | | 8/1976 | Patel et al. | |
| 4,274,482 A | | 6/1981 | Sonoda | |
| 4,936,381 A | | 6/1990 | Alley | |
| 4,945,635 A | | 8/1990 | Nobusue | |
| 5,025,855 A | | 6/1991 | Hoshino et al. | |
| 5,630,473 A | * | 5/1997 | Nishishita | 165/153 |
| 5,875,834 A | | 3/1999 | Brooks | |
| 6,129,144 A | * | 10/2000 | Bousquet | 165/153 |
| 6,318,455 B1 | * | 11/2001 | Nakado et al. | 165/153 |

FOREIGN PATENT DOCUMENTS

| | | |
|---|---|---|
| EP | 0 563 474 A1 | 10/1993 |
| EP | 0 709 630 A2 | 5/1996 |
| EP | 0 727 625 A2 | 8/1996 |
| EP | 0 843 143 A2 | 5/1998 |
| EP | 0 905 467 A2 | 3/1999 |
| JP | 3-247993 | 2/1992 |

* cited by examiner

*Primary Examiner*—Henry Bennett
*Assistant Examiner*—Tho V Duong
(74) *Attorney, Agent, or Firm*—Dykema Gossett PLLC

(57) ABSTRACT

A heat exchanger which is particularly useful as an evaporator has a first plurality of stacked plate pairs with cooling fins therebetween. A second plurality of stacked plate pairs is located adjacent to the first. Each plurality of plate pairs has enlarged plate end portions which together define flow manifolds. The first plate pairs have a first inlet manifold and a first outlet manifold. The second plate pairs have a second inlet manifold and second outlet manifold. The first outlet manifold is joined to communicate with the second outlet manifold. The second inlet manifold is joined to communicate with the first inlet manifold, but a barrier is located between the first and second inlet manifolds. The barrier has an orifice to permit a portion only of the flow in the first inlet manifold to pass into the second inlet manifold to produce a more uniform flow distribution inside the heat exchanger.

14 Claims, 9 Drawing Sheets

HEAT EXCHANGERS WITH FLOW DISTRIBUTING ORIFICE PARTITIONS

BACKGROUND OF THE INVENTION

This invention relates to heat exchangers, and in particular, to heat exchangers involving gas/liquid, two-phase flow, such as in evaporators or condensers.

In heat exchangers involving two-phase, gas/liquid fluids, flow distribution inside the heat exchanger is a major problem when the two-phase flow passes through multiple channels which are all connected to common inlet and outlet manifolds, the gas and liquid have a tendency to flow through different channels at different rates due to the differential momentum and the changes in flow direction inside the heat exchanger. This causes uneven flow distribution for both the gas and the liquid, and this in turn directly affects the heat transfer performance, especially in the area close to the outlet where the liquid mass proportion is usually quite low. Any maldistribution of the liquid results in dry-out zones or hot zones. Also, if the liquid-rich areas or channels cannot evaporate all of the liquid, some of the liquid can exit from the heat exchanger. This often has deleterious effects on the system in which the heat exchanger is used. For example, in a refrigerant evaporator system, liquid exiting from the evaporator causes the flow control or expansion valve to close reducing the refrigerant mass flow. This reduces the total heat transfer of the evaporator.

In conventional designs for evaporators and condensers, the two-phase flow enters the inlet manifold in a direction usually perpendicular to the main heat transfer channels. Because the gas has much lower momentum, it is easier for it to change direction and pass through the first few channels, but the liquid tends to keep travelling to the end of the manifold due to its higher momentum. As a result, the last few channels usually have much higher liquid flow rates and lower gas flow rates than the first one. Several methods have been tried in the past to even out the flow distribution in evaporators. One of these is the use of an apertured inlet manifold as shown in U.S. Pat. No. 3,976,128 issued to Patel et al. Another approach is to divide the evaporator up into zones or smaller groupings of the flow channels connected together in series, such as is shown in U.S. Pat. No. 4,274,482 issued to Noriaki Sonoda. While these approaches tend to help a bit, the flow distribution is still not ideal and inefficient hot zones still result.

SUMMARY OF THE INVENTION

In the present invention, barriers or partitions are used in the inlet manifold to divide the heat exchanger into sections. The barriers have orifices to allow a predetermined proportion of the flow to pass through to subsequent sections, so that the flow in the sequential sections is maintained in parallel and more evenly distributed.

According to the invention, there is provided a heat exchanger comprising a first plurality of stacked, tube-like members having respective inlet and outlet distal end portions defining respective of inlet and outlet openings. All of the inlet openings are joined together so that the inlet distal end portions form a first inlet manifold, and all of the outlet openings are joined together so that the outlet distal end portions form a first outlet manifold. A second plurality of stacked, tube-like members is located adjacent to the first plurality of tube-like members. The second plurality of tube-like members also has inlet and outlet distal end portions defining respective inlet and outlet openings. All of the inlet openings are joined together so that the inlet distal end portions form a second inlet manifold and all of the outlet openings are joined together so that the outlet distal end portions form a second outlet manifolds. The second outlet manifold is joined to communicate with the first outlet manifold. The second inlet manifold is joined to communicate with the first inlet manifold. A barrier is located between the first and second inlet manifolds. The barrier defines an orifice to permit the portion only of the flow in the first inlet manifold to pass into the second inlet manifold.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENT

Figure 1:
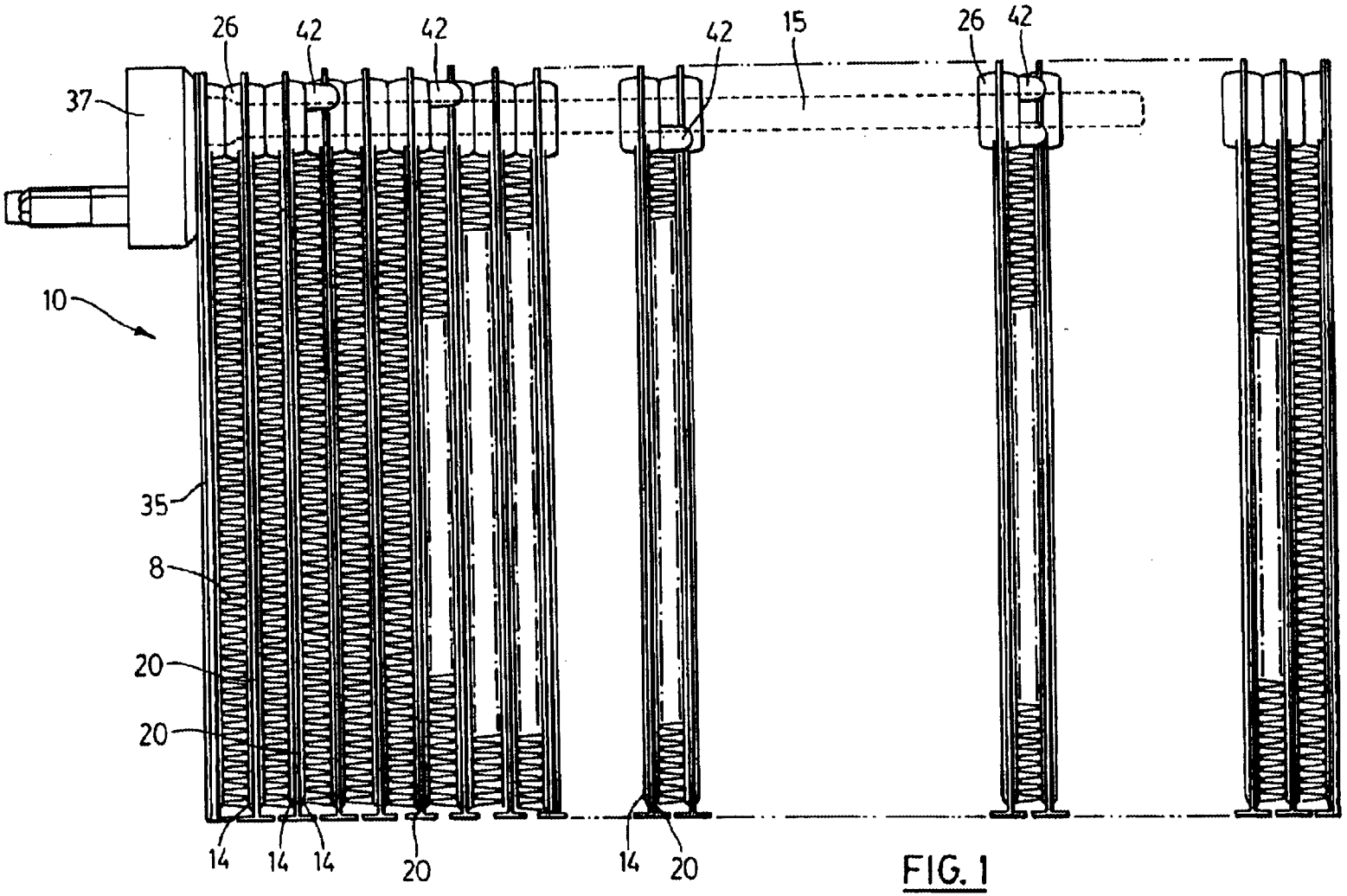
FIG. 1 is an elevational view of a preferred embodiment of a heat exchanger according to the present invention.
Figure 2:
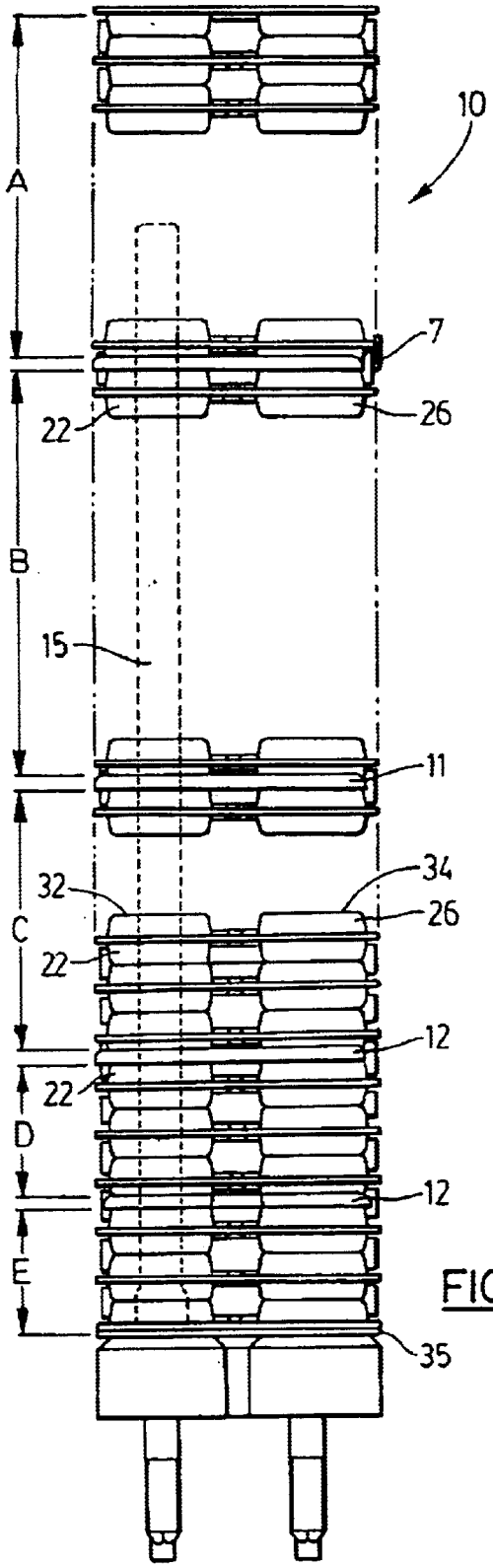
FIG. 2 is a top or plan view of the heat exchanger shown in FIG. 1.
Figure 3:
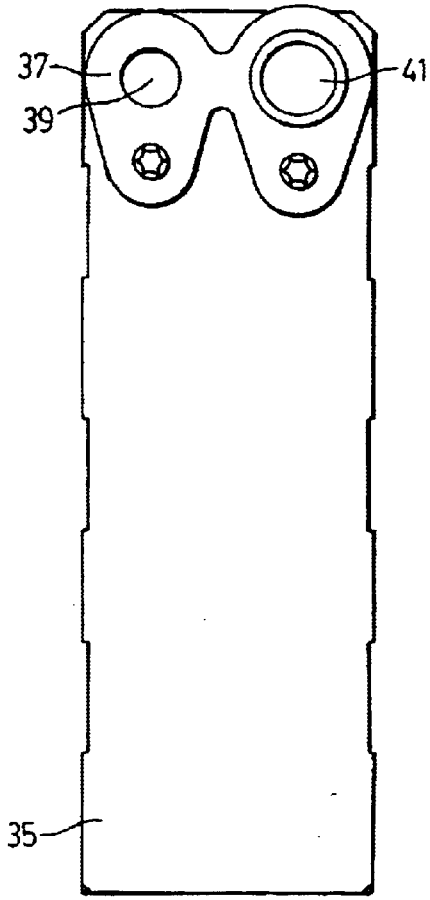
FIG. 3 is a left end view of the heat exchanger shown in FIG. 1.
Figure 5:
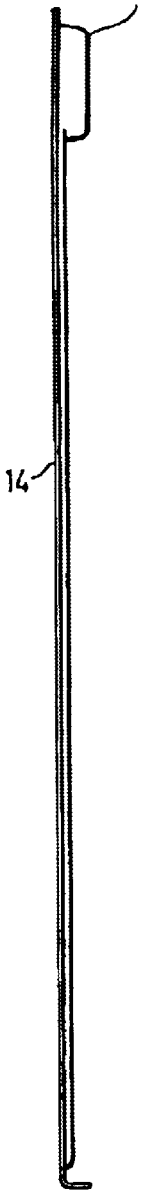
FIG. 5 is a left side or edge view of the plate shown in FIG. 4.
Figure 4:
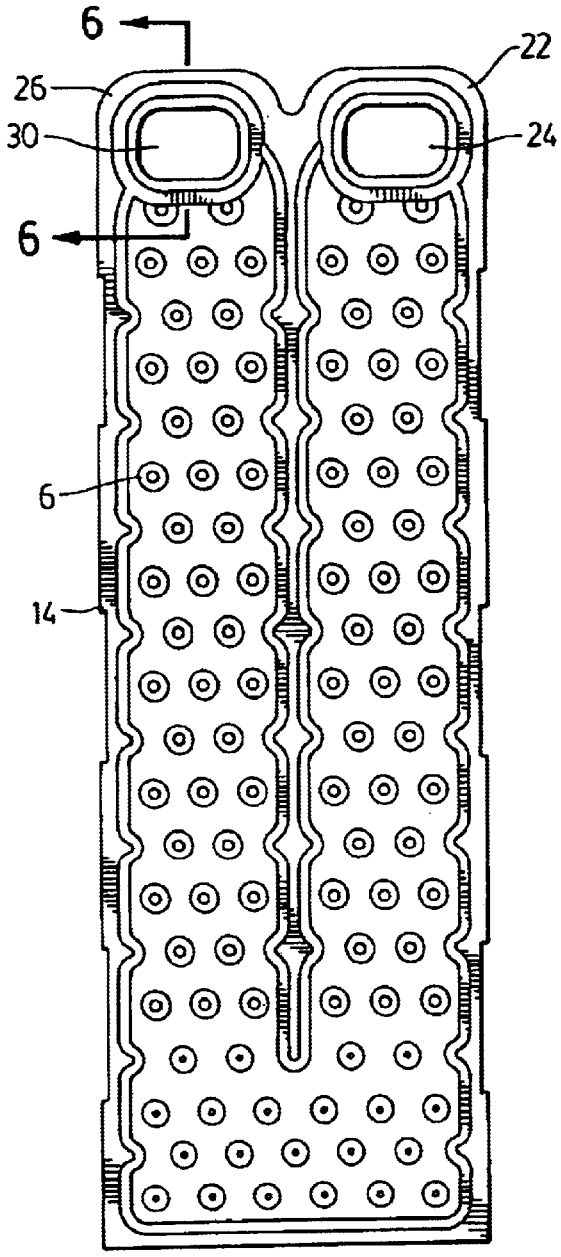
FIG. 4 is an enlarged elevational view of one of the main core plates used to make the heat exchanger of FIG. 1.
Figure 6:
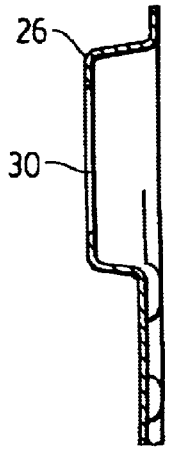
FIG. 6 is an enlarged sectional view taken along lines 6—6 of FIG. 4.

Referring firstly to FIGS. 1 to 6, a preferred embodiment of the present invention is made up of a plurality of plate pairs 20 formed of back-to-back plates 14 of the type shown in FIGS. 4 to 6. These are stacked, tube-like members having enlarged distal end portions or bosses 22, 26 having inlet 24 and outlet 30 openings, so that the flow travels in a U-shaped path through the plate pairs 20. Each plate 14 preferably includes a plurality of evenly spaced dimples 6 projecting into the flow channel created by each plate pair 20. Preferably, fins 8 are located between adjacent plate pairs. The bosses 22 on one side of the plate are joined together to form an inlet manifold 32 and the bosses 26 on the other side of the plates are joined together to form an outlet manifold 34. As seen best in FIG. 2, a longitudinal tube 15 passes into the inlet manifold openings 24 in the plates to deliver the incoming fluid, such as a two-phase, gas/liquid mixture of refrigerant, to the right hand section of the heat exchanger 10. FIG. 3 shows end plate 35 with an end fitting 37 having openings 39, 41 in communication with the inlet manifold 32 and outlet manifold 34, respectively.

Figure 7:
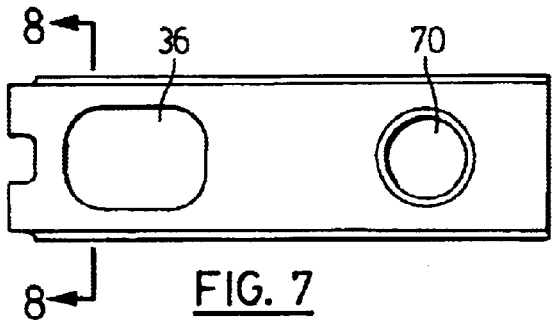
FIG. 7 is a plan view of one type of barrier or partition shim plate used in the heat exchanger shown in FIGS. 1 to 3.
Figure 8:
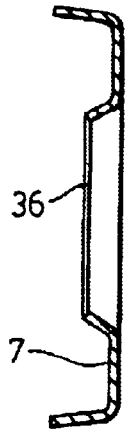
FIG. 8 is an enlarged sectional view taken along lines 8—8 of FIG. 7.
Figure 9:
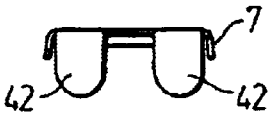
FIG. 9 is a left end view of the barrier plate shown in FIG. 7.
Figure 10:
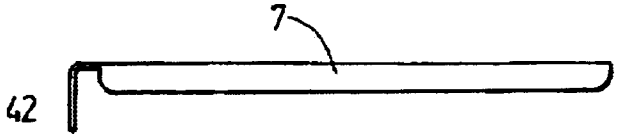
FIG. 10 is a front or elevational view of the barrier plate shown in FIG. 7.
Figure 11:
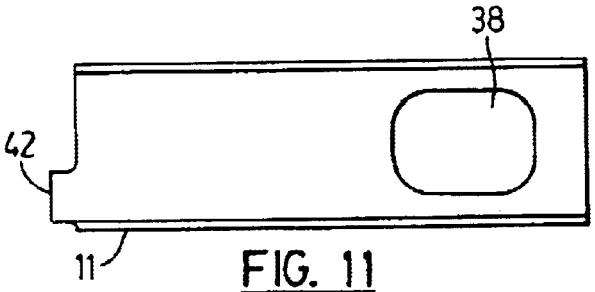
FIG. 11 is a plan view, similar to FIG. 7, but showing another type of barrier or partition plate used in the heat exchanger of FIGS. 1 to 3.
Figure 12:
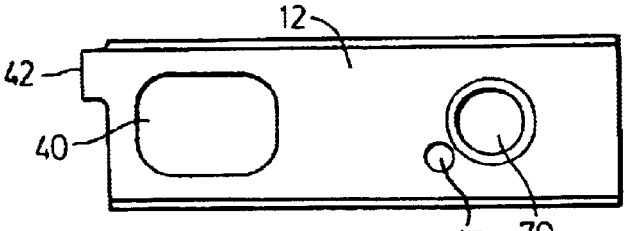
FIG. 12 is plan view, similar to FIGS. 7 and 11, but showing yet another type of barrier or partition plate used in the heat exchanger of FIGS. 1 to 3.
Figure 21:
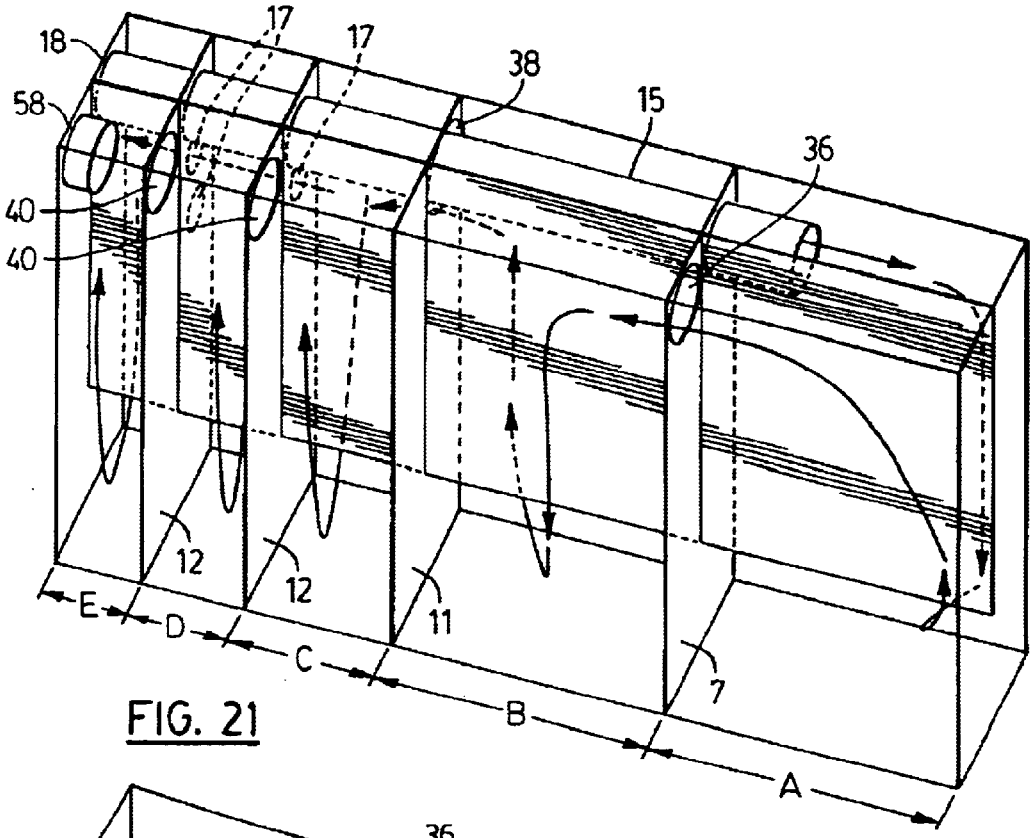
FIG. 21 is a diagrammatic perspective view taken from the front and from the right side showing the flow path inside the heat exchanger of FIGS. 1 to 3.
Figure 22:
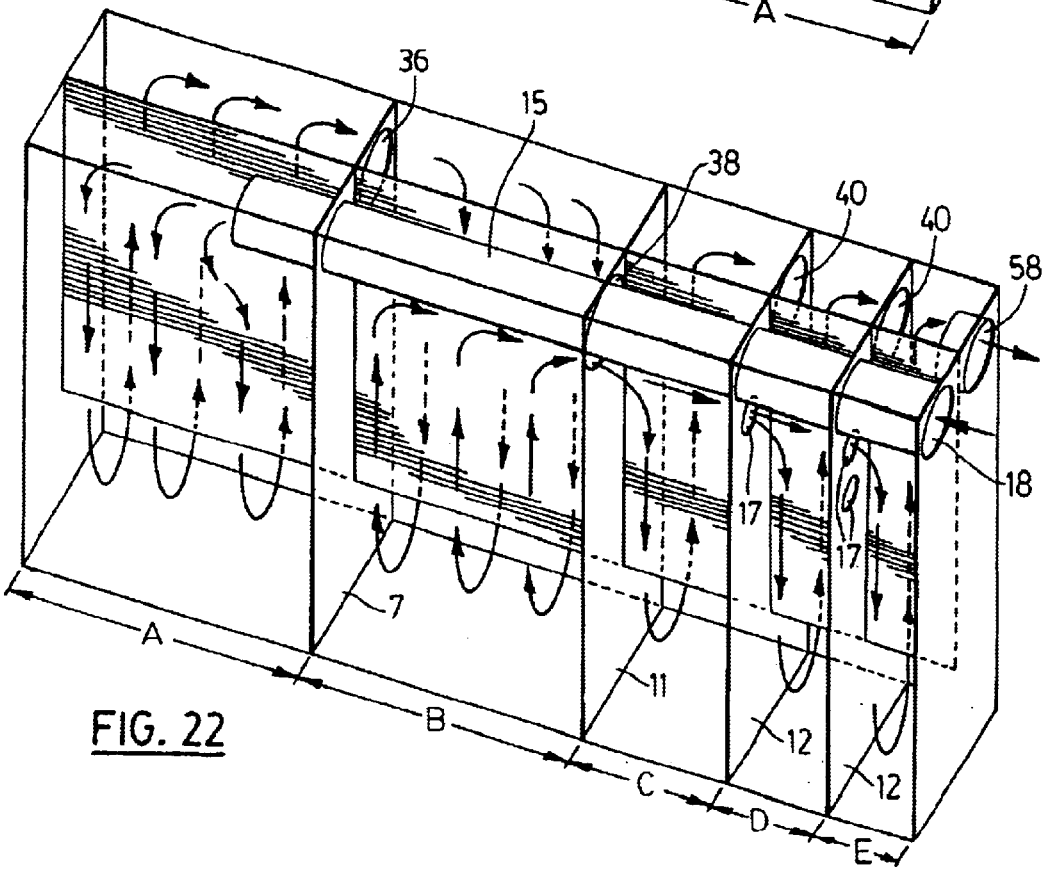
FIG. 22 is a perspective view similar to FIG. 21, but taken from the rear and from the left side of the heat exchanger of FIGS. 1 to 3.

The heat exchanger 10 is divided into plate pair sections A, B, C, D, E by placing barrier or partition plates 7, 11, 12, such as are shown in FIGS. 7 to 12, between selected plate pairs in the heat exchanger. The inlet and outlet manifolds formed in the plate pairs of each section may be considered separate manifolds from each other, the inlet manifolds of adjacent sections being joined to communicate with one another and the outlet manifolds of adjacent sections being joined to communicate with one another. For example the inlet manifold 32 of section C is joined to communicate with the inlet manifold of section D and the outlet manifold of section C is joined to communicate with the outlet manifold of section D. Referring to FIGS. 21 and 22, sections are shown schematically, and the dividing walls represent actual barrier plates 7, 11, and 12 as shown in FIGS. 7, 11 and 12. As shown in FIGS. 7 to 12, each barrier may have an end flange or flanges 42 positioned such that the barrier plates can be distinguished from one another when positioned in the heat exchanger. For example barrier plate 7 has two end flanges 42, barrier plate 11 has a lower positioned end flange 42 and barrier plate 12 has an upper positioned end flange 42. The direction of flow is indicated with arrows. Referring again to FIGS. 21 and 22, an inlet tube 15 delivers the fluid through an inlet 18 to the right hand section A of the heat exchanger where it would travel down along the back, or along the right hand side of the plates 14 as seen in FIG. 4, cross over and travel up the front, or along the left hand side of the plates as seen in FIG. 4. Barrier plates 7, 12 each include an opening 70 to accommodate the inlet tube 15. The flow then passes through a left hand hole 36 of barrier 7, traveling down along the font of the next section B of plates, across and up the back of these plates to pass through a hole 38 in barrier plate 11 (see FIG. 11) which surrounds tube 15.

Most of the flow then travels down the backside add up the front of the next section C of the heat exchanger plates and passes out via the outlet manifold through an outlet hole 40, which is the left hand hole of the barrier plate 12 shown in FIG. 12 through to the outlet manifold of section D. However, some of the flow passes via the inlet manifold of section C through a small orifice 17 (see FIG. 12) and into the inlet manifold of the next section D of core plates. In this next section D, flow again travels down the back and up the front and out through the outlet hole 40 in the next barrier 12. Again some of the flow goes through the inlet manifold through an orifice 17 into the inlet manifold of yet another section E of core plates. In this last section E of core plates, the flow goes down the back, up the front and finally out of the heat exchanger outlet 58.

Referring again to FIG. 21, it will be appreciated that in the first two sections of core plates from the right A, B the fluid is flowing in series through these sections. However, when the fluid reaches the third section C, most of it travels in the U-shaped direction, but some of it is passed via the inlet manifold through the small orifices 17 in plates 12, to the next section's inlet manifold so that the flow in the last three sections of core plates is in parallel. This parallel flow produces proportional, even flow distribution to balance the flow rate among all of the sections in the heat exchanger.

Figure 13:
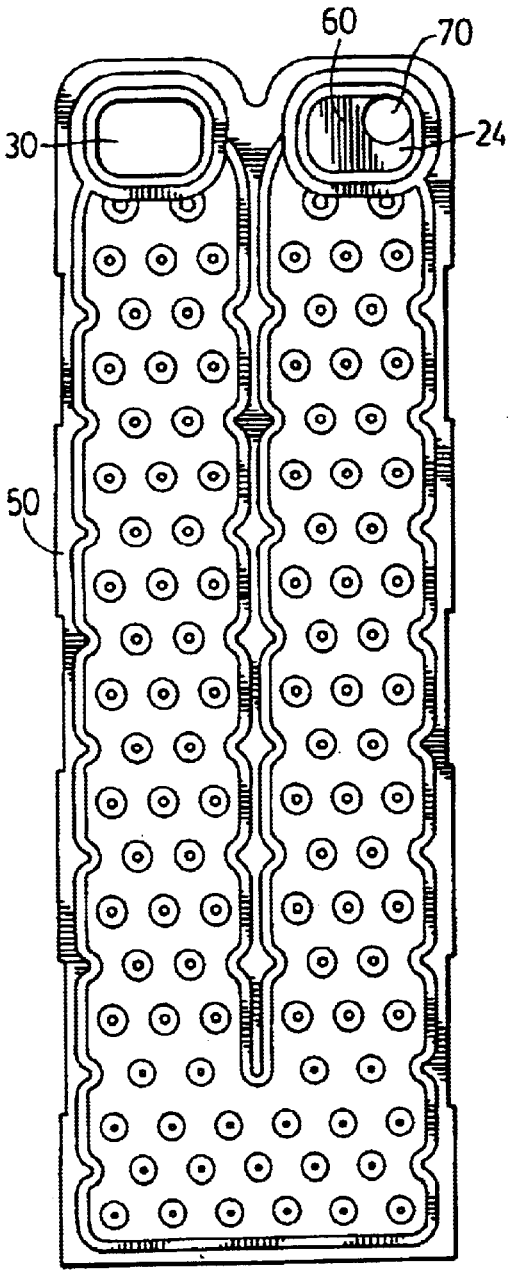
FIG. 13 is an elevational view, similar to FIG. 4, but showing another type of core plate used in the heat exchanger of FIGS. 1 to 3.
Figure 14:
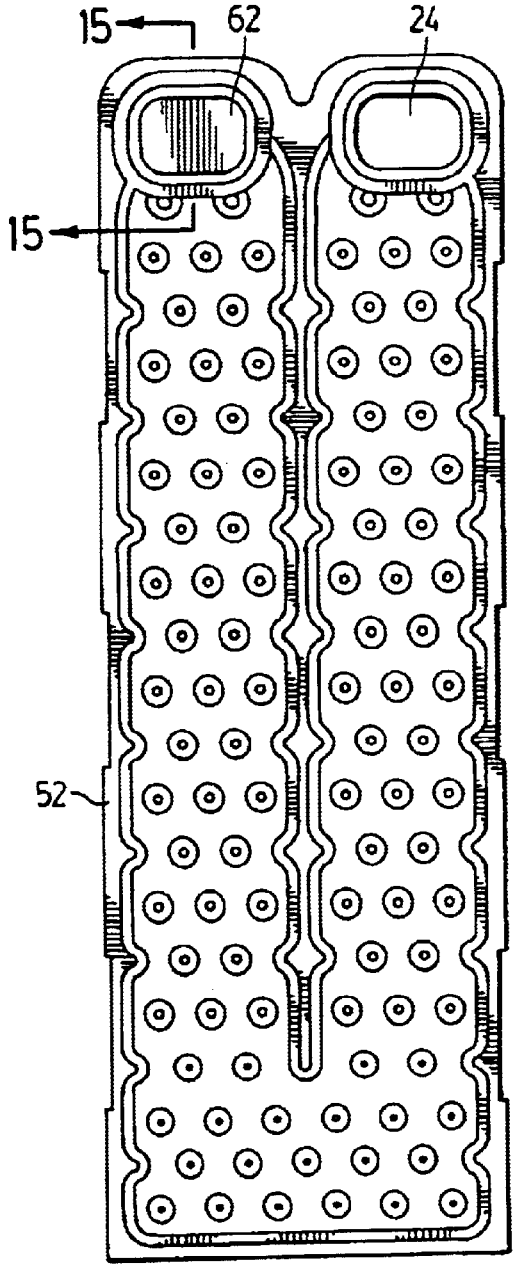
FIG. 14 is an elevational view similar to FIGS. 4 and 13, but showing yet another type of core plate used in the heat exchanger of FIGS. 1 to 3.
Figure 15:
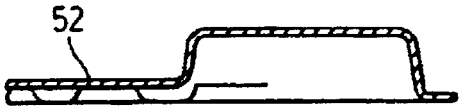
FIG. 15 is an enlarged sectional view taken along lines 15—15 of FIG. 14.
Figure 16:
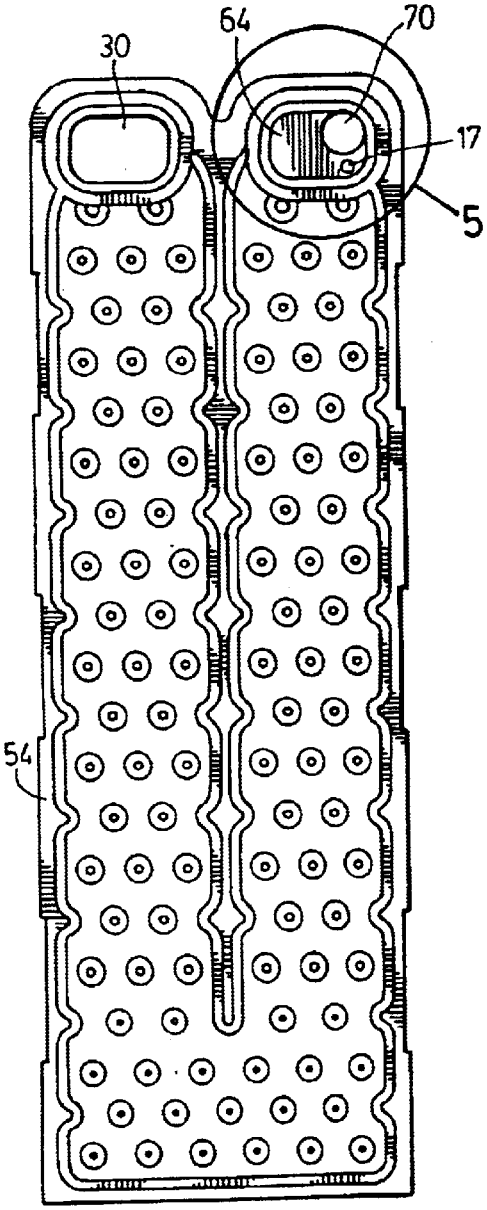
FIG. 16 is an elevational view similar to FIGS. 4, 13 and 14, but showing yet another type of core plate used in the heat exchanger of FIGS. 1 to 3.
Figure 17:
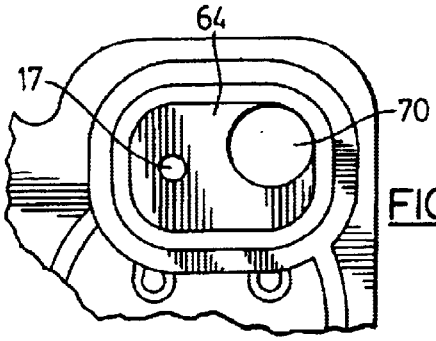
FIG. 17 is an enlarged scrap view of the area indicated by circle 5 in FIG. 16, but showing a modification to the location of the orifice.
Figure 18:
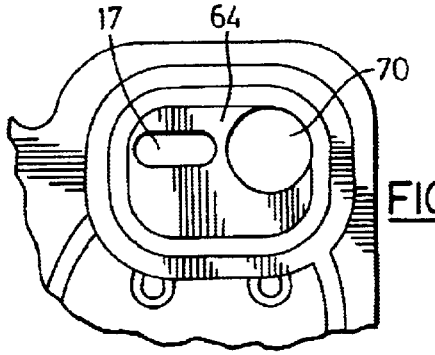
FIG. 18 is a scrap view similar to FIG. 17 but showing yet another modification to the flow orifice.
Figure 19:
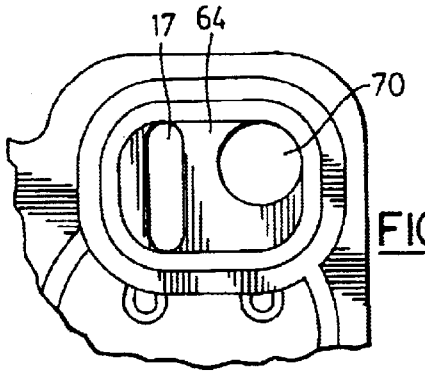
FIG. 19 is a scrap view similar to FIGS. 17 and 18 but showing yet another modification to the flow orifice.
Figure 20:
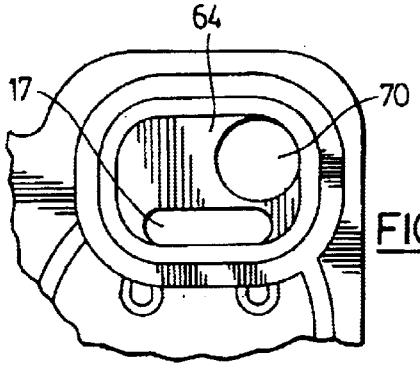
FIG. 20 is a scrap view similar to FIGS. 17 to 19 but showing yet another modification to the flow orifice.

Rather than using the core plates of FIG. 4 and the barrier or partition plates of FIGS. 7 to 12, the partitions of FIGS. 7 to 12 could actually be built right in or made an integral part of the core plates 50, 52, 54 as shown in FIGS. 13 to 16. Core plate 50 as shown in FIG. 13 is equivalent to core plate 14 of FIG. 4 with a barrier plate 7 of FIG. 7 in that it has outlet opening 30 but inlet opening 24 includes an integral barrier 60 with a hole 70 therethrough to accomodate tube 15. Core plate 52 of FIG. 14 is equivalent to core plate 14 of FIG. 4 with a barrier plate 11 of FIG. 11 in that outlet opening 30 is blocked by an integral barrier 62 and inlet opening 24 is not blocked. Core plate 54 of FIG. 16 is equivalent to core plate 14 of FIG. 4 with a barrier or partition plate 12 of FIG. 12 in that inlet opening 24 is blocked by an integral barrier 64 having a hole 70 to accommodate tube 15 and an orifice 17 thereby allowing a portion of flow to pass through the inlet manifold to the next section. It will be appreciated that the core plates of FIG. 13 and FIG. 14 would be used in the FIG. 21 embodiment in the location of the respective partitions 7 and 11. The core plate shown in FIG. 16 would be used where the partitions 12 are indicated in FIG. 21.

FIGS. 17 to 20 show different configurations of orifices 17 in core plates that would be used in the location of barriers 12 in the embodiment of FIG. 21. The different orifices 17 are used to balance the flow rates amongst all of the sections in the manifold. The flow rates can be controlled by adjusting the sizes or locations (top or bottom) or the shapes of the orifices, such as round, vertical slot, horizontal slot or any other configuration. The location of the orifice high or low on the partition or core plate can be used to adjust the proportion of liquid to gas phase within the flow that is passed through the orifice, while the size of the hole is used more to adjust the overall mass flow rate. The sensitivities of the orifice size and location will tend to be application-specific, depending on how well mixed the two phases of the flow are at the point of flow splitting. Also, rather than one orifice hole, several smaller holes would be used. Further, the orifice in the first partition plate could be larger, or there could be more orifices, than in the second or down stream partition or barrier (see FIGS. 21 and 22).

Figure 23:
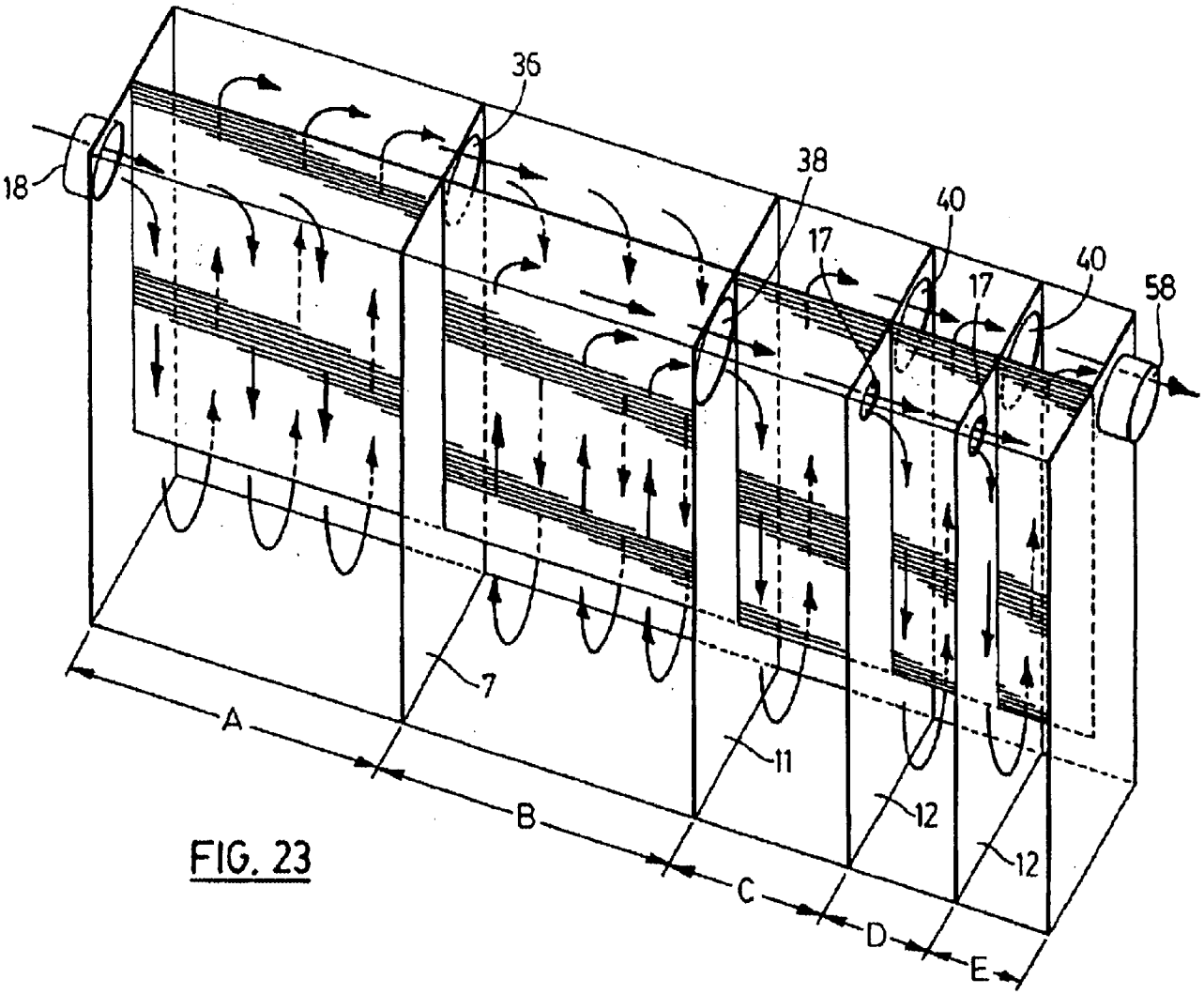
FIG. 23 is a perspective view similar to FIGS. 21 and 22, but illustrating the flow path in another preferred embodiment of the present invention.
Figure 24:
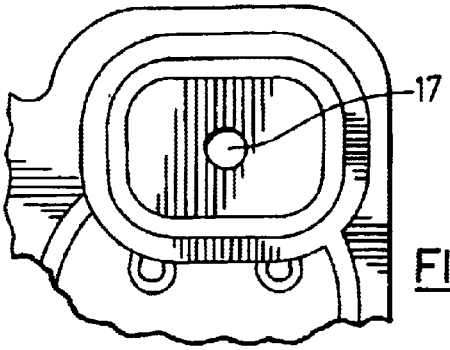
FIG. 24 is a scrap view similar to FIG. 17, but showing a portion of one of the core plates that is used in the embodiment of FIG. 23.
Figure 25:
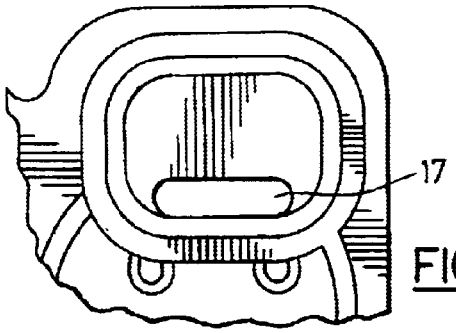
FIG. 25 is a scrap view similar to FIG. 24 but showing a modified type of orifice.
Figure 26:
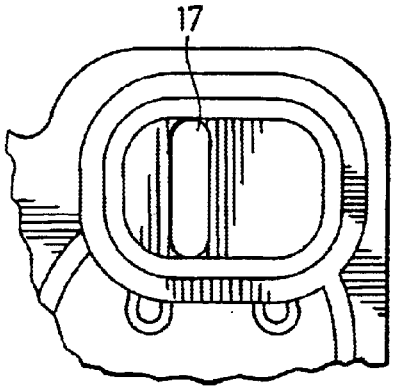
FIG. 26 is a scrap view similar to FIGS. 24 and 25, but showing yet another modification to the orifice.
Figure 27:
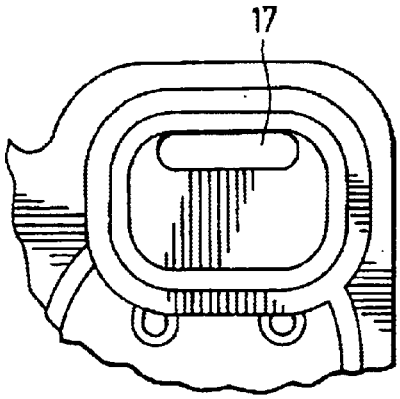
FIG. 27 is a scrap view similar to FIGS. 24 to 26, but showing yet another modification to the orifice.

In the embodiment represented by FIG. 23, it will be noted that there is no longitudinal inlet tube. The flow as indicated with arrows enters the left side of the heat exchanger, travels in series through the first two sections, and then in parallel through the last three sections in a manner similar to that of the embodiment of FIGS. 21 and 22. In this FIG. 23 embodiment, it will also be noted that the inlet 18 and outlet 58 are at opposite ends of the heat exchanger, rather than being adjacent as in the embodiment of FIGS. 21 and 22. In the embodiment of FIG. 23, the core plates would not have holes to accommodate a longitudinal inlet tube, as indicated in FIGS. 24 to 27. Similar modifications will be made to the barrier or partition plates 7, 11, 12 of FIGS. 7 and 12, if such barriers are used with the core plates 14 of FIG. 4 to make a heat exchanger as indicated in FIG. 23.

Figure 28:
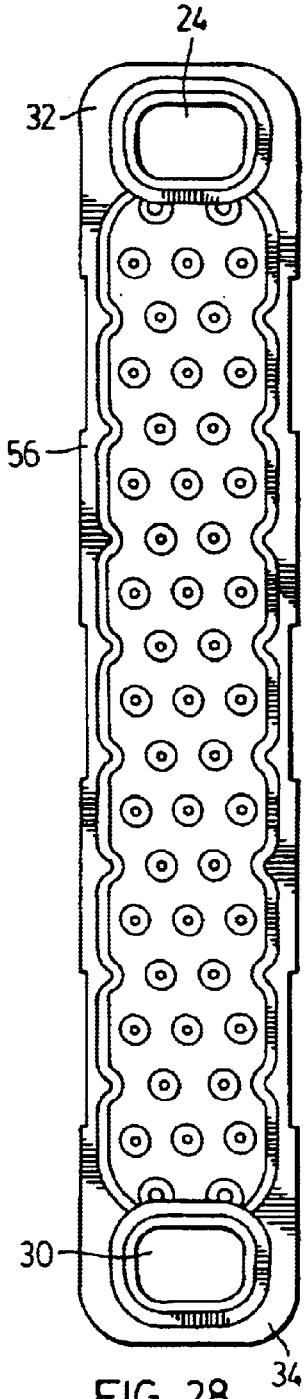
FIG. 28 is an elevational view of a core plate that is used in another preferred embodiment of the invention where the inlet and outlet manifolds are located at opposed ends of the core plate, rather than being adjacent as in the embodiments shown in FIGS. 1 to 3.

As mentioned above, the flow through the core plates travels in a U-shaped path in the embodiments of FIGS. 1 to 27. However, this U-shaped path could be, in effect, straightened out, in which case core plates 56 as shown in FIG. 28 would be used.

As will be apparent to those skilled in the art in the light of the foregoing disclosure, many alterations and modifications are possible in the practice of this invention without departing from the spirit or scope thereof. The foregoing description is of the preferred embodiments and is by way of example only, and is not to limit the scope of the invention.

What is claimed is:

1. A heat exchanger comprising:

a first plurality (C) of stacked, tube-like members having respective first inlet and first outlet distal end portions defining respective first inlet and first outlet openings, all of said first inlet openings being joined together so that the first inlet distal end portions form a first inlet manifold and all of said first outlet openings being joined together so that the first outlet distal end portions form a first outlet manifold;

a second plurality (D) of stacked, tube-like members located adjacent to said first plurality of tube-like members, the second plurality of tube-like members having second inlet and second outlet distal end portions defining respective second inlet and second outlet openings, all of said second inlet openings being joined together so that the second inlet distal end portions form a second inlet manifold and all of said second outlet openings being joined together so that the second outlet distal end portions form a second outlet manifold;

a third plurality (E) of stacked, tube-like members located adjacent to said second plurality (D) of tube-like members, the third plurality of tube-like members having third inlet and third outlet distal end portions defining respective third inlet and third outlet openings, all of said third inlet openings being joined together so that the third inlet distal end portions form a third inlet manifold and all of said third outlet openings being joined together so that the third outlet distal end portions form a third outlet manifold;

the second outlet manifold being joined to communicate with the first outlet manifold;

the second inlet manifold being joined to communicate with the first inlet manifold;

a first barrier located between the first and second inlet manifolds, the first barrier defining a first orifice to permit a portion only of the flow in the first inlet manifold to pass into the second inlet manifold;

the third outlet manifold being joined to communicate with the second outlet manifold;

the third inlet manifold being joined to communicate with the second inlet manifold;

a second barrier located between the second and third inlet manifolds, the second barrier defining a second orifice to permit a portion only of the flow in the second inlet manifold to pass into the third inlet manifold, said first orifice and said second orifice having different configurations; and a fluid inlet tube for the heat exchanger that passes through the first, second and third inlet manifolds and through openings provided through the first and second barriers, the openings being discrete from the orifices.

2. A heat exchanger according to claim 1 wherein the first and second barriers engage the fluid inlet tube about circumferences of the respective openings therethrough.

3. A heat exchanger as claimed in claim 1 wherein the size of the first orifice is larger than the size of the second orifice.

4. A heat exchanger as claimed in claim 1 wherein a greater number of orifices are provided through the first barrier than through the second barrier.

5. A heat exchanger as claimed in claim 1 wherein at least one of the effective size, relative location, and shape of the first orifice is different than that of the second orifice.

6. A heat exchanger as claimed in claim 1 wherein at least one of the first barrier and the second barrier has a plurality of the orifices formed therethrough, the collective effective size of all orifices through the first barrier being larger than that of all orifices through the second barrier.

7. A heat exchanger as claimed in claim 1 wherein the shape of the second orifice is different than that of the first orifice.

8. A heat exchanger as claimed in claim 1 wherein a relative location of the first orifice on the first barrier is different from that of the second orifice on the second barrier.

9. A heat exchanger according to claim 2 wherein the first and second barriers are discrete baffle plate inserts.

10. A heat exchanger according to claim 1 wherein the first barrier is integrally formed in one of the adjacent portions of the first and second inlet manifolds and the second barrier is integrally formed in one of the adjacent end portions of the second and third inlet manifolds.

11. A heat exchanger as claimed in claim 1 wherein said portion of the flow passing through the first orifice is small enough that it does not materially affect the flow velocity through the first plurality of stacked tube-like members.

12. A heat exchanger as claimed in claim 1 wherein at least one of orifices is a horizontal slot.

13. A heat exchanger as claimed in claim 1 wherein at least one of said orifices is a vertical slot.

14. A heat exchanger as claimed in claim 1 wherein each said tube-like member is a plate pair formed of back-to-back plates defining a flow channel therebetween.

* * * * *